US010714834B2

(12) United States Patent
Diaz et al.

(10) Patent No.: US 10,714,834 B2
(45) Date of Patent: Jul. 14, 2020

(54) BROADBAND QUAD-RIDGE HORN ANTENNAS

(71) Applicants: Rodolfo E. Diaz, Phoenix, AZ (US); Mahkamehossadat Mostafavi, Tempe, AZ (US)

(72) Inventors: Rodolfo E. Diaz, Phoenix, AZ (US); Mahkamehossadat Mostafavi, Tempe, AZ (US)

(73) Assignee: Arizona Board of Regents on behalf of Arlzona State University, Scottsdale, AZ (US)

( * ) Notice: Subject to any disclaimer, the term of this patent is extended or adjusted under 35 U.S.C. 154(b) by 380 days.

(21) Appl. No.: 15/849,120

(22) Filed: Dec. 20, 2017

(65) Prior Publication Data

US 2018/0175507 A1 Jun. 21, 2018

Related U.S. Application Data

(60) Provisional application No. 62/436,856, filed on Dec. 20, 2016.

(51) Int. Cl.
*H01Q 13/02* (2006.01)
*H01Q 5/28* (2015.01)
(Continued)

(52) U.S. Cl.
CPC ..... *H01Q 13/0275* (2013.01); *H01Q 5/28* (2015.01); *H01Q 13/0241* (2013.01);
(Continued)

(58) Field of Classification Search
CPC ..... H01Q 5/28; H01Q 25/04; H01Q 19/08; H01Q 13/0275; H01Q 13/0283; H01Q 13/0241; H01Q 13/0258
See application file for complete search history.

(56) References Cited

U.S. PATENT DOCUMENTS 6,419,538 B1 7/2002 Diaz
6,473,048 B1 10/2002 Diaz
(Continued)

FOREIGN PATENT DOCUMENTS

WO 2000033414 A2 6/2000
WO 2003081715 A2 10/2003
(Continued)

OTHER PUBLICATIONS

U.S. Appl. No. 16/399,924.
ETS-Lindgren L.P., Model 3164 Series—Open Boundary Quad-Ridged Horns: User Manual, Mar. 1, 2007, 97 pages.

*Primary Examiner* — Robert Karacsony
(74) *Attorney, Agent, or Firm* — Fish & Richardson P.C.

(57) ABSTRACT

Broadband antennas are described that include a quad-ridge horn inside which two different lenses are inserted creating a broadband horn-lens combination. One of these lenses is a cross-polyrod lens, formed from a pair of polyrods disposed in a crossed arrangement, each polyrod shaped in a predetermined manner. The other one of these lenses is a prolate spheroidal lens. The broadband antennas can produce, at the output thereof, Gaussian-like beams in both principal polarizations from VHF to 20 GHz. As such, the broadband antennas can be used to perform material measurements in a compact admittance tunnel. Simulation results show that directivity of quad-ridge horns can be improved using the combination of lenses of the broadband antennas. Therefore, the broadband antennas can also be of interest for far-field radiation applications.

20 Claims, 11 Drawing Sheets

(51) Int. Cl.
*H01Q 25/04* (2006.01)
*H01Q 19/08* (2006.01)

(52) U.S. Cl.
CPC ..... *H01Q 13/0258* (2013.01); *H01Q 13/0283* (2013.01); *H01Q 19/08* (2013.01); *H01Q 25/04* (2013.01)

(56) References Cited

U.S. PATENT DOCUMENTS

| | | | | |
|---|---|---|---|---|
| 6,980,716 | B1 | 12/2005 | Diaz et al. | |
| 7,132,640 | B2 | 11/2006 | Diaz et al. | |
| 7,688,268 | B1 * | 3/2010 | West ..... | H01Q 13/0275 343/770 |
| 7,786,946 | B2 | 8/2010 | Diaz et al. | |
| 7,889,148 | B2 | 2/2011 | Diaz et al. | |
| 7,889,149 | B2 | 2/2011 | Diaz et al. | |
| 8,324,894 | B2 | 12/2012 | Diaz et al. | |
| 8,952,857 | B2 | 2/2015 | Diaz | |
| 10,020,581 | B2 | 7/2018 | Diaz et al. | |
| 10,111,612 | B2 | 10/2018 | Diaz et al. | |
| 2019/0131697 | A1 | 5/2019 | Diaz et al. | |

FOREIGN PATENT DOCUMENTS

| | | | |
|---|---|---|---|
| WO | 2004044179 | A2 | 5/2004 |
| WO | 2008079391 | A1 | 7/2008 |
| WO | 2010025470 | A2 | 3/2010 |
| WO | 2016134107 | A1 | 8/2016 |

* cited by examiner

BROADBAND QUAD-RIDGE HORN ANTENNAS

CROSS-REFERENCE TO RELATED APPLICATIONS

This application claims the benefit of priority under 35 U.S.C. § 119(e)(1) of U.S. Provisional Application No. 62/436,856, filed on Dec. 20, 2016, which is incorporated by reference herein.

TECHNICAL FIELD

This application describes generally broadband antennas, and more specifically, quad-ridge horn antennas that produce Gaussian-like beams at the output of the horn in both principal polarizations with frequencies from 0.7 GHz to 20 GHz.

BACKGROUND

A conventional broadband antenna, that produces Gaussian-like beams having a single polarization direction, is described in U.S. Pat. No. 7,889,148. The conventional broadband antenna includes a ridge horn and a waveguide which is at least partially inside the ridge horn. The waveguide includes a central dielectric slab, an upper slab above the central dielectric slab and a lower slab below the central dielectric slab. These slabs have a lower dielectric constant compared with the central one. The central slab increases in width toward the ridge horn and its thickness is substantially constant and less than a quarter of a wavelength at the highest frequency of operation. The conventional broadband antenna can be used in a measurement system for providing a substantially plane wave interaction between the electromagnetic wave and a sample at an operation frequency ranging from 0.7 GHz to 20 GHz.

SUMMARY

In this specification, broadband antennas are described that include a quad-ridge horn inside which two different lenses are inserted creating a broadband horn-lens combination. One of these lenses is a cross-polyrod lens, formed from a pair of polyrods disposed in a crossed arrangement, each polyrod shaped in a predetermined manner. The other one of these lenses is a prolate spheroidal lens. The disclosed antennas can produce Gaussian-like beams at the output of the horn in both principal polarizations from VHF to 20 GHz. As such, the disclosed broadband antennas can be used to perform material measurements in a compact admittance tunnel. Simulation results show that directivity of quad-ridge horns can be improved using the combination of lenses of the disclosed broadband antennas. Therefore, the disclosed broadband antennas can also be of interest for far-field radiation applications.

One aspect of the disclosure can be implemented as a broadband antenna that includes a horn including a first feed arranged and configured such that the horn will provide, along an optical axis of the broadband antenna, a first input wave having a first polarization orthogonal to the optical axis, and a second feed arranged and configured such that the horn will provide along the optical axis a second input wave having a second polarization orthogonal to the optical axis and the first polarization; a first lens arranged with a first end proximal to the horn and a second end distal to the horn, the first and second ends of the first lens being on the optical axis, the first lens including a first dielectric slab and a second dielectric slab that orthogonally intersect each other along the optical axis, and are rotated about the optical axis by 45° relative to the orthogonal first and second polarizations, such that the first dielectric slab and the second dielectric slab are EM coupled with either of the first feed and the second feed, where each of the first dielectric slab and the second dielectric slab includes a first dielectric material having a first permittivity; and a second lens arranged with a first end proximal to the horn and second end distal to the horn, the first and second ends of the second lens being on the optical axis, such that the output end of the first lens is between the horn and the output end of the second lens, where the second lens is shaped to encapsulate at least portions of the first and second dielectric slabs that are adjacent to the optical axis, where the second lens includes a second dielectric material having a second permittivity smaller than the first permittivity.

Implementations can include one or more of the following features. In some implementations, the horn can include a first pair of conductive ridges connected to the first feed and arranged parallel to the first polarization, and a second pair of conductive ridges connected to the second feed and arranged parallel to second polarization.

In some implementations, each of the dielectric slabs can be thinner than a quarter of a minimum wavelength of a beam produced by the broadband antenna, the minimum wavelength corresponding to a maximum frequency of an operating frequency range.

In some implementations, each of the dielectric slabs can be wider adjacent to the first end of the first lens than adjacent to the second end of the first lens. In some cases, each of the dielectric slabs can have a width that varies over at least a portion of its length based on a hyperbolic tangent function of a distance from the first end of the first lens. In some cases, each of the dielectric slabs can have a width at the second end of the first lens that is smaller than a quarter of a minimum wavelength of a beam produced by the broadband antenna, the minimum wavelength corresponding to a maximum frequency of an operating frequency range.

In some implementations, the first material of each of the dielectric slabs can have a permittivity in a range of 2-3. In some cases, the first material of each of the dielectric slabs can be an acrylic.

In some implementations, the second lens can be shaped as a prolate spheroid that is arranged with its long axis along the optical axis. In some cases, the second lens can include four sectors of the prolate spheroid each of which is shaped as a quarter of prolate spheroid, the four sectors being arranged such that each pair of sectors is disposed adjacent to one side of one of the dielectric slabs and sandwiches half of the other one of the dielectric slabs.

In some implementations, the second material of the second lens can have a permittivity in a range of 1.2-1.6. In some cases, the second material of the second lens can be a polymer foam. For example, the polymer foam is a polystyrene foam.

In some implementations, a combination of (i) respective dimensions of the horn, the first lens and the second lens and (ii) respective permittivities thereof is configured to cause the broadband antenna to produce Gaussian-like beams with waists located adjacent the second end of the second lens and amplitudes that vary less than 10 dB over frequencies in an operational frequency range of 0.7 GHz to 20 GHz.

Yet another aspect of the disclosure can be implemented as a radiation source that includes the disclosed broadband antenna; and a power source coupled to the disclosed broadband antenna. The power source can be configured to interchangeably power the first feed to cause the broadband antenna to produce a first Gaussian-like beam having the first polarization, or the second feed to cause the broadband antenna to produce a second Gaussian-like beam having the second polarization.

Yet another aspect of the disclosure can be implemented as a measurement system for measuring material properties of a sample that includes the foregoing radiation source; a sample holder having an aperture, the sample holder to support a sample disposed on a propagation path of Gaussian-like beams produced by the radiation source and directed through the sample and the aperture. The sample holder can be spaced apart from the radiation source such that the aperture is adjacent a location of waists of the Gaussian-like beams produced by the radiation source. Additionally, the measurement system can include a receiver configured to receive the Gaussian-like beams transmitted through the sample and the aperture.

Yet another aspect of the disclosure can be implemented as a method of fabricating a broadband antenna including a horn configured to provide, along an optical axis of the broadband antenna, (i) a first input wave having a first polarization orthogonal to the optical axis, and (ii) a second input wave having a second polarization orthogonal to the optical axis and the first polarization. The method includes forming a first lens from a first dielectric slab and a second dielectric slab by arranging the second dielectric slab to intersect orthogonally the first dielectric slab, wherein each of the first dielectric slab and the second dielectric slab comprises a first dielectric material having a first permittivity; inserting at least a portion of the first lens into the horn, such that the intersected first and second dielectric slabs are rotated about the optical axis by 45° relative to the orthogonal first and second polarizations; and forming a second lens by (i) cutting a prolate spheroid symmetrically into four pieces along its long axis, and (ii) inserting the first lens inside the four pieces so they, at least partially, encapsulate the first lens, wherein the prolate spheroid comprises a second dielectric material having a second permittivity smaller than the first permittivity.

Implementations can include one or more of the following features. In some implementations, the method can include shaping each of the first and second dielectric slabs to have a width that varies over at least a portion of its length based on a hyperbolic tangent function. Here, the inserting of the at least a portion of the first lens into the horn comprises inserting a wider end of each of the first and second dielectric slabs into the horn, such that a narrower end of each of the first and second dielectric slabs protrudes outside of the horn.

In some implementations, the method can include forming each of the first and second dielectric slabs to have both a thickness and a distal-end width that are smaller than a quarter of a minimum wavelength of a beam produced by the broadband antenna. Here, the first lens is inserted into the horn such that the distal end of the first and second dielectric slabs protrudes outside of the horn. Also, the minimum wavelength corresponding to a maximum frequency of an operating frequency range.

In some implementations, the cutting of the prolate spheroidal shape symmetrically into four pieces along its long axis can include obtaining four sectors of the prolate spheroid each of which being shaped as a quarter of prolate spheroid. Additionally, the inserting of the first lens inside the four pieces can include arranging the four sectors such that each pair of sectors is disposed adjacent to one side of one of the dielectric slabs and sandwiches half of the other one of the dielectric slabs.

The disclosed technologies can result in one or more of the following potential advantages. The prolate spheroidal lens is made from a material that has a lower dielectric constant than the cross-polyrod lens and surrounds the cross-polyrod lens symmetrically forming a compound polyrod. As described and as simulated in a full-physics computational model, this dual polarization compound polyrod has been installed in a quad-ridged horn whose ridges originate as a four conductor (e.g., four parallel wires) transmission line. As such, the transmission lines feeding the quad ridge horn have operational frequencies down to zero. In this manner, the low-frequency performance of the disclosed broadband antenna can be fully appreciated and is improved relative to the low-frequency performance of the conventional broadband antenna described in U.S. Pat. No. 7,889,148.

It will be understood by a person versed in the art that if a conventional quad-ridged horn (such as, e.g., 3164-10 Open Boundary Quad-Ridged Horn sold by ETS-Lindgren), in which the four ridges originate in a waveguide region (that is, forming a short circuit at the low frequency end of the band), were used to be fitted with the disclosed compound polyrod lens, instead of the ideal four conductor transmission line horn used here, then the horn itself would limit the low frequency performance of the horn-lens antenna combination. Nevertheless, an appropriately fitted compound polyrod of design essentially conforming to that disclosed here will enable such a commercially available horn to derive the advantages provided by the compound polyrod and can be used to advantage in both material testing and far field measurements.

Working with two polarizations can potentially speed up material measurements and calibration processes. For instance, only the feed port used in the disclosed broadband antenna needs to be changed when the disclosed broadband antenna is used for material measurements, without the need for physical rotation of the antenna, as in the case when the conventional broadband antenna is used. As such, the disclosed broadband antenna can be used to perform material measurements in situations where the direction of the incident field is of importance, such as for radiating anisotropic materials or for measurements in which a probe wave impinging on a sample surface forms a non-zero angle of incidence with the normal to the sample surface.

Moreover, we showed through simulation results that the directivity of a simple quad-ridge horn can be improved using the disclosed lenses. Therefore, disclosed broadband antenna can also be of interest for far-field radiation applications.

Additionally, the disclosed broadband antenna also shows an improvement in the gain of the conventional broadband antenna described in U.S. Pat. No. 7,889,148 at mid (above 3 GHz) to high frequencies.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
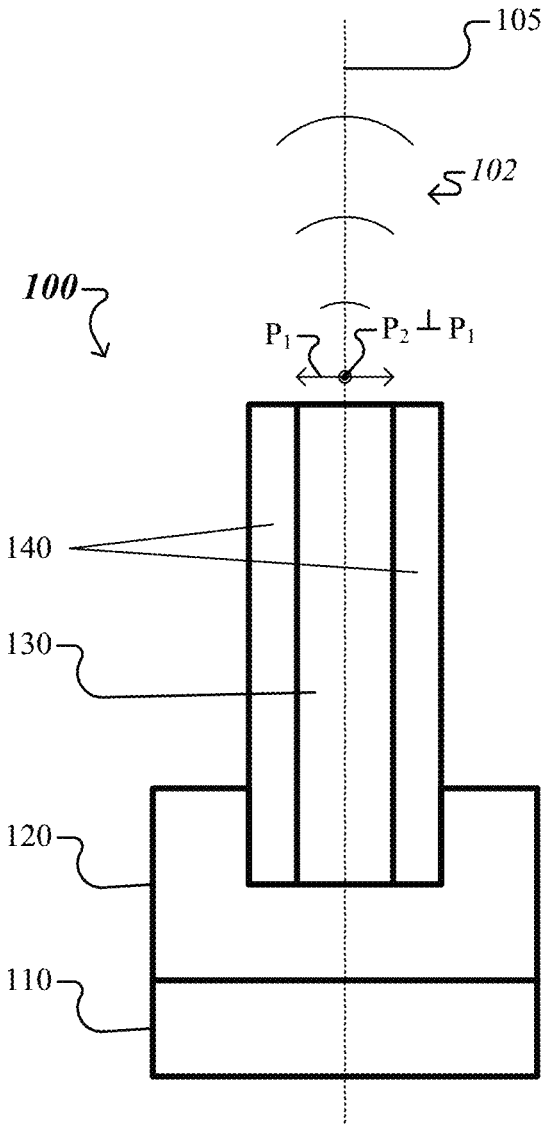
FIG. 1 shows a diagrammatic representation of a broadband antenna that radiates Gaussian-like beams in both principal polarizations along an optical axis.

In this specification, broadband antennas are described that can produce Gaussian-like beams in both principal polarizations from VHF to 20 GHz. FIG. 1 shows a diagrammatic representation of such an antenna 100 that radiates the Gaussian-like beams 102 in both principal polarizations ($P_1$ and $P_2$, where $P_2 \perp P_1$) along an optical axis 105. The antenna 100 includes a feeding system 110, a quad-ridge horn 120 coupled with the feeding system, a cross-polyrod lens 130 inserted at least partially in the quad-ridge horn, and a prolate spheroidal lens 140 that encapsulates at least a portion of the cross-polyrod lens. These components are described below.

Feeding System Implementation

Ridged horns are typically fed from ridged waveguides. That is the feed includes a metal boundary, which could be a cylindrical or square cross section pipe, which is terminated at one end with a metal wall (a short circuit). The ridges start at a designed distance from this metal wall and they are fed usually via a coax that penetrates the ridge.

Figure 2:
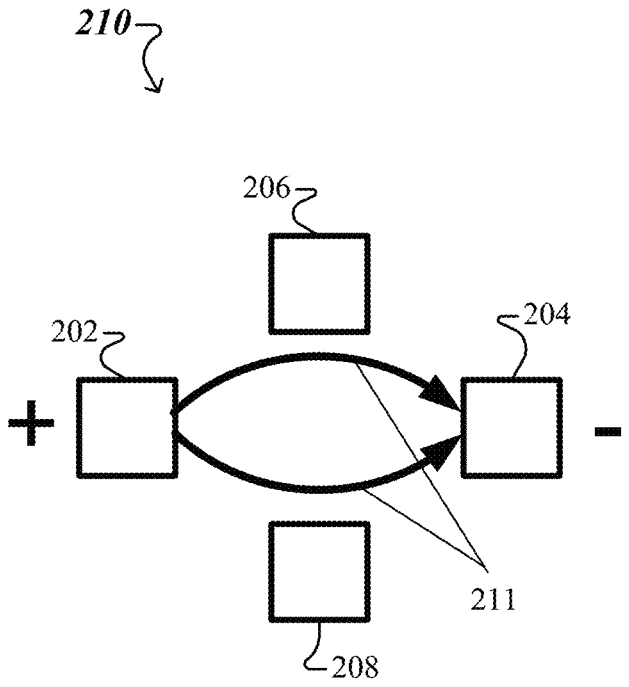
FIG. 2 shows an example of a cross section of conductors (transmission lines) used to feed a horn of a broadband antenna.

Since the proximate short reflects a short circuit at the feed coax, the input impedance of these horns becomes vanishingly small below the operating designed frequency. To obtain a horn that, in principle, works down to DC, the disclosed broadband antennas use a twin-line transmission line feed design with no waveguide walls where the ridges (or fins) of the horn are the extension of the twin-line. FIG. 2 shows a schematic cross section of a feeding system 210 which includes conductors (transmission lines) 202, 204 and 206, 208 used to feed a horn of the disclosed broadband antenna.

To obtain quad-ridge operation, a four conductor transmission line feeding four ridges is used. Such a transmission line has 3 linearly independent modes (four modes if a surrounding ground plane is counted as an additional conductor) two of which are "sum" modes and excite opposite fins with opposite polarity, thus leading to the linear polarization desired from each pair of fins.

The design of the four conductor transmission line can follow conventional stripline mode-former procedures as those used to create a feed circuit for four-arm spiral antennas. The idea is to have a stripline circuit with up to four 50 Ohms inputs that generates the desired modes at the four strips at the end of the mode former. In the case of the quad-ridge horn used for measuring materials, it is enough to have two 50 Ohms coax inputs each of which is transformed via the stripline circuit to a pair of strips. This is the so called balun problem where the "unbalanced" voltage distribution of the coaxial line is transformed to the "balanced" (symmetric) distribution of a twin-strip transmission line. Such a design of the twin-line four conductor feed is typically performed based on particular requirements of the customer's problem (dimensions of horn, desired match, frequency of operation).

The feeding system 210 was used for obtaining high-frequency structure simulation (HFSS) results described in this application. The four ridges of the horn are essentially the continuation of conductors 202, 204 and 206, 208 as described in the following section. For simplicity, only the E field 211 in the direction shown in FIG. 2 is used in simulations. For simplicity in simulations, and also to better discern the radiation polarization of the disclosed broadband antenna, only one pair of the transmission line conductors, e.g., 202, 204, is excited.

Horn Implementation

The common explanation of the frequency domain behavior of horns recognizes that the energy at a given frequency tends to "peel off" ridges of the horns when the ridge separation is of the order of $\lambda/2$. Thus, these ridge horns are intrinsically broadband antennas at the high frequency end. Furthermore, launching of a wave in the direction of travel tends to make the radiation pattern of a horn symmetric in both principal planes and gives it significant directivity.

At the low frequency end, the performance of the horn is expected to resemble the performance of Schelkunoff's V-antenna, the latter being a dipole antenna with its arms tilted forward. In that case, the radiation pattern in the E-plane will tend to have some directivity in the far field because of the natural nulls aligned with the arms, but in the H-plane it will become increasingly omnidirectional. However, in the near field, since the E-field is attached to the arms, the pattern in the E-plane may appear elongated relative to the pattern in the H-plane. Furthermore, when the horn becomes electrically small (e.g., length and aperture smaller than $\lambda/4$), it becomes equivalent to a small dipole radiator. These considerations then bound the expectations of the performance of a horn combined with one or more polyrod lenses. Here, it is expected to attain nearly Gaussian beam behavior at some mid frequency range. This behavior is retained through the high frequency end (as in the conventional broadband antenna described in U.S. Pat. No. 7,889,148). However, at the low frequency end the radiation pattern will smoothly degrade to that of a small dipole.

Since admittance tunnels use an iris on the ground plane and NRL (Naval Research Laboratory) arches use finite size ground planes, the fixture limitation at the low frequency end is not only a function of the horn, but of the test fixture size. Thus, the fact that the horn becomes a dipole radiator at the low frequency end would be immaterial if, at the same frequency, the iris is also becoming electrically small.

Optimization of the ridge horn design involves, first, attaining a single radiated main lobe as a function of frequency from the low frequency end through the high frequency end. This is mostly a function of the shaping of ridges of the ridge horn to encourage "peeling off" of the wave. The second part of the optimization of the ridge horn is the choice of low end termination. As described above, at the low frequency end, the horn tends to behave as a twin-line fed V-dipole. If left unterminated, standing waves will be sustained between the feed and the open end that could introduce a ripple into the input match of the horn. Therefore, another termination strategy is the lossy termination.

Moreover, TEM horns (also required to operate over ultra-broadband frequency ranges) can be terminated with resistive planes from the aperture to a ground at the back of the horn. Various termination schemes have been used to implement the disclosed broadband antennas, such as, e.g., loading the outside edge of the fins with lossy magnetic material (magram) to improve the input impedance at the low frequency end. The foregoing optimization of the TEM horns has been performed based on customer requirements and is part of the engineering work used to adapt the disclosed broadband antennas to the customer's particular needs.

Figure 3A:
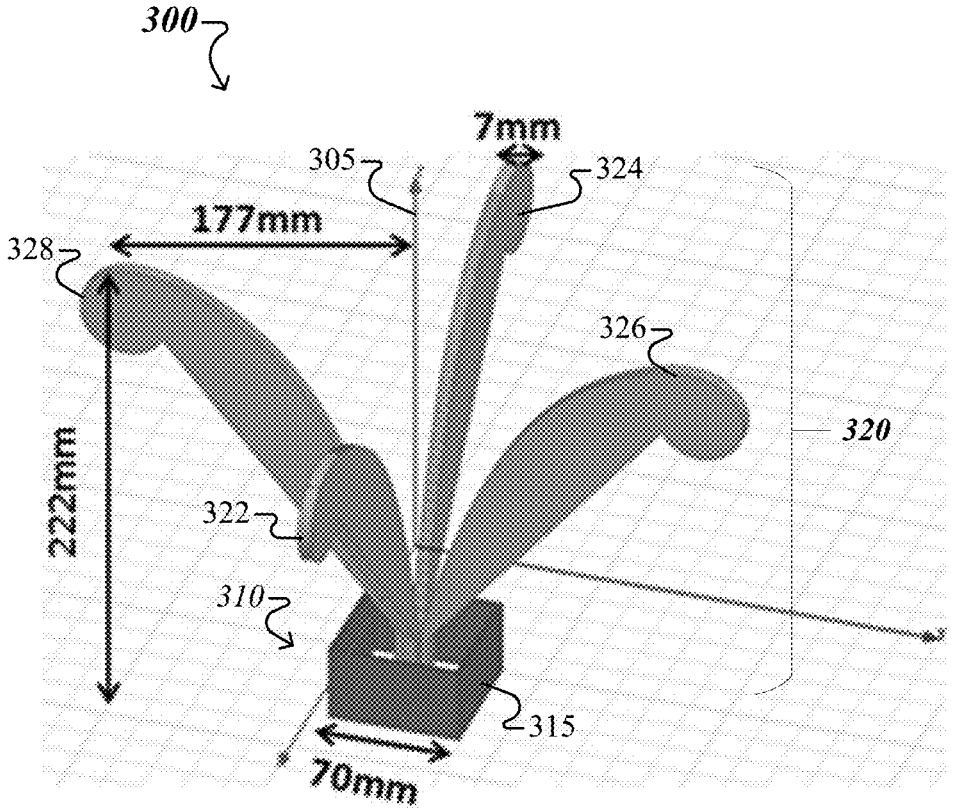
FIGS. 3A-3C show aspects of an example of a broadband antenna with a quad ridge horn.

FIG. 3A shows a quad ridge horn 320 and a portion of its feeding system 310 as they are implemented as part of a broadband antenna 300. The horn 320 includes 4 ridges with flaring angle of 45 degrees. Dimensions of the feed lines also are illustrated. In the example illustrated in FIG. 3A, an optical axis 305 of the broadband antenna 300 is along the z-axis. Two of the ridges 326, 328 are along Y-axis and two others 322, 324 are along X-axis.

The curvature y of each of the ridges 322, 324 and 326, 328 uses equation (1):

$$y=ae^{-bx},\ a=150\text{ mm},\ b=0.02 \tag{1}$$

The values of parameter x are chosen based on the required flare angle (relative to the optical axis 305) and height of the ridges (along the optical axis 305), in accordance with equation (2):

$$0 < x < \frac{\text{height}}{\tan(\text{flare angle})}. \tag{2}$$

Figure 3B:
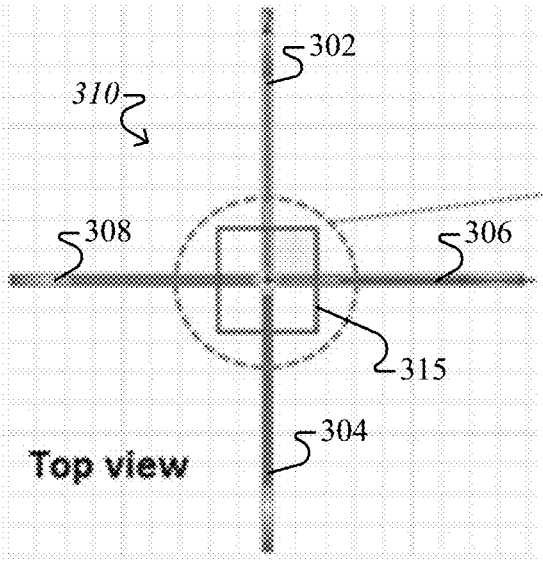

FIG. 3B is a top view of the feeding system 310 showing that it includes four conductors 302, 304 and 306, 308 connected to the respective ridges 322, 324, 326, 328. Note that if the feeding system 310 feeds the horn 320 using four parallel conductors in which opposite pairs are excited as 2-wire transmission lines, e.g., as shown in FIG. 2, then the four conductors 302, 304 and 306, 308 are directly connected to the respective transmission line conductors 202, 204 and 206, 208. In the examples illustrated in FIGS. 3A-3B, the 2-wire transmission lines have an exterior ground shield that is terminated to a metal case 315 (also referred to as enclosure). In this manner, each of these 2-wire transmission lines can be excited by a coaxial cable in a way that, e.g., the transmission line conductor 202 connects to the center conductor of a coaxial cable and the transmission line conductor 204 connects to the outer conductor of the coaxial cable. Here, a side coupled microstrip, or a strip line, or any type of typical connection for such transformation (from coax to conductors) can be used.

Figure 3C:
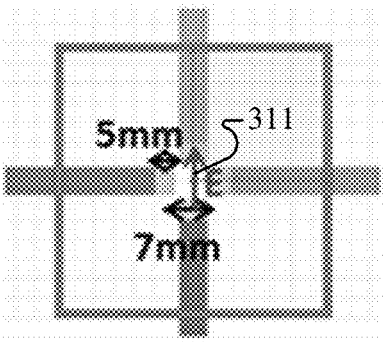

FIG. 3C is a zoomed view of the feeding system 310 of FIG. 3B which shows that, here, the feeding system is excited in a way that the E field 311 of the excitation port is in the Y direction. Simulations of the structure shown in FIGS. 3A-3B were performed for a quarter of the whole shape using symmetric boundary conditions in ANSYS HFSS.

Implementation of High-Frequency Lens—Cross-Polyrod Lens

A high frequency lens can be generally implemented as a TM dielectric surface waveguide. Such waveguide, also called polyrod, is shaped like a slab that guides the waves along its geometry and by radiating out TM waves gradually results in a Gaussian beam at a hot spot in the Fresnel region in front of its tip. This Gaussian beam is a good approximation of a plane wave which can be used for illuminating the samples in an admittance tunnel. In U.S. Pat. No. 7,889,148, a polyrod lens is used that includes an arctan shaped dielectric (typically acrylic or Plexiglas) of 0.09" thickness.

Figure 4:
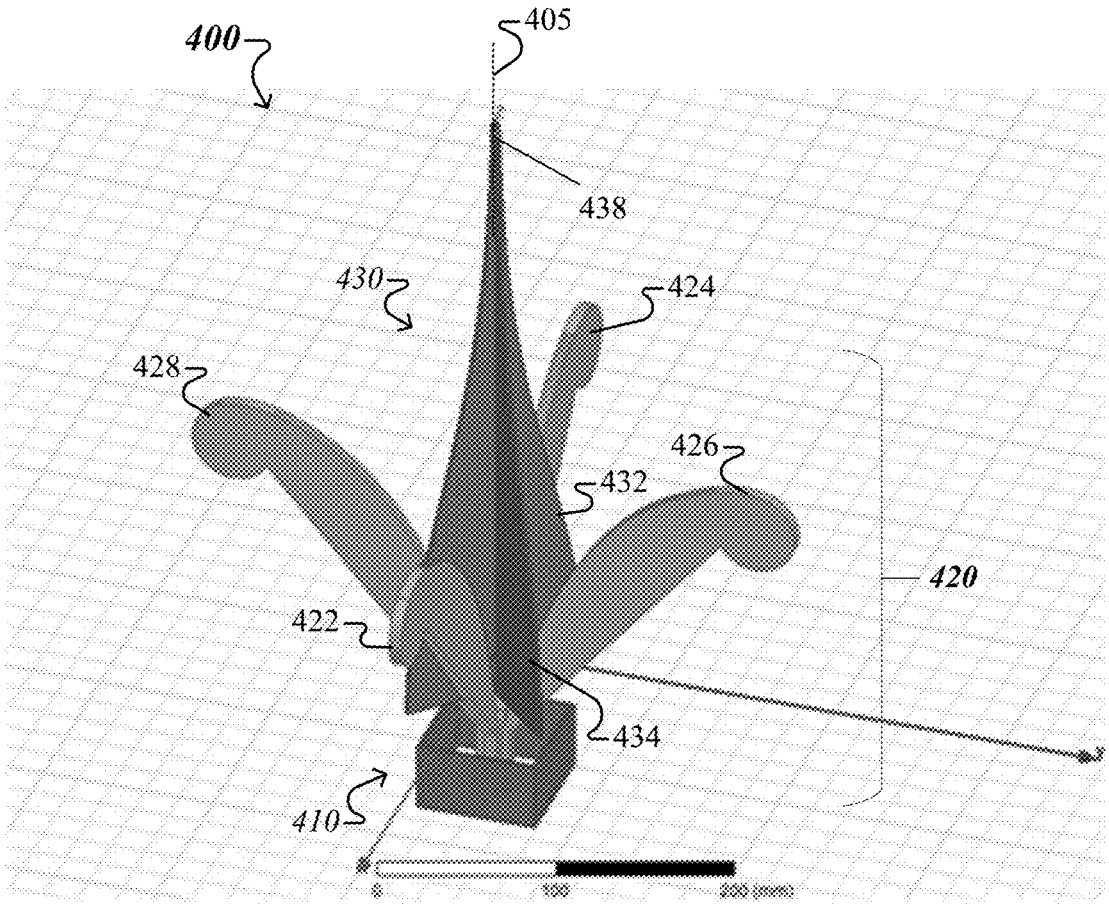
FIG. 4 shows an example of a broadband antenna with a cross-polyrod lens inserted inside a quad-ridge horn.

FIG. 4 shows a portion of a broadband antenna 400 which includes a quad ridge horn 420 and its feed 410, and a cross-polyrod lens 430. Since the broadband antenna 400 is designed to emit TM waves in either of two orthogonal polarizations, the cross-polyrod lens 430 is shaped and configured so that it guides the TM waves for both polarizations of the feeding system 410. Therefore, the cross-polyrod lens 430 includes two polyrods 432, 434 perpendicular to each other, each polyrod being a dielectric slab shaped as described below.

The cross-polyrod lens 430 is placed inside the four metal ridges 422, 424 and 426, 428 of the horn 420 in a way that its four sides are 45 degrees rotated with respect to the metal ridges, as shown in FIG. 4. Specifically, the two dielectric slabs 432, 434 of the cross-polyrod lens 430 intersect along the optical axis 405 (here the z-axis) of the broadband antenna 400; further, a first edge of the first dielectric slab 432 is inserted between the pair of metal ridges 422, 428 and a second edge of the first dielectric slab 432 is inserted between the pair of metal ridges 424, 426; furthermore, a first edge of the second dielectric slab 434 is inserted between the pair of metal ridges 422, 426 and a second edge of the second dielectric slab 434 is inserted between the pair of metal ridges 424, 428.

Each polyrod 432, 434 plays the role of a TM dielectric surface waveguide in the plane perpendicular to a pair of ridges. The dielectric can include a low loss acrylic with permittivity in a range between 2-3, e.g., 2.6. It is important that the permittivity of inner lens (i.e., cross-polyrod lens) 430 be larger than the permittivity of the outer lens (i.e., prolate spheroid lens described in the next section). The shape of dielectric slabs 432, 434 used in the cross-polyrod lens 430 is a tan h-like function as shown in equation (3):

$$f(x) = -\left(\tanh\frac{x}{147}\right)^{2.8}\cdot\left(55.59-\frac{tw}{2}\right)+55.59. \tag{3}$$

Figure 5:
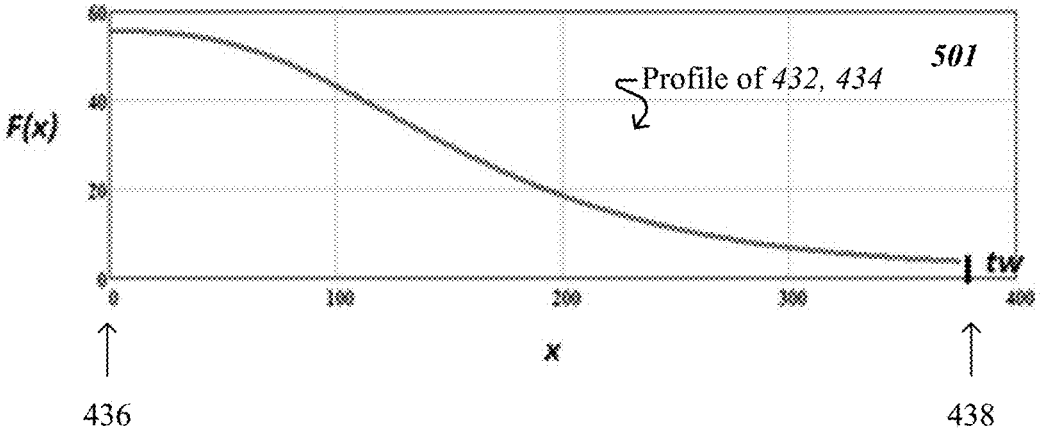
FIG. 5 shows an example of a geometry of each polyrod of a cross-polyrod lens.

FIG. 5 shows the geometry 501 of each polyrod 432, 434 of the cross-polyrod lens 430 given in terms of EQ. (3). The width (tw) of the tip 438 of the component polyrod 432, 434 is 4.174 mm and the starting width at the input end is 55.59 mm. The thickness of the component polyrod 432, 434 is 1.89 mm (less than a quarter of a wavelength at the highest frequency of operation) and its length is 375 mm. The tip 438 of the component polyrod 432, 434 is smaller than quarter of a wavelength for the maximum design frequency. This is to prevent any back and forth reflections at the tip 438. In addition, the starting width at the input end 436 and the length of the component polyrod 432, 434 are related to each other to maintain the smoothness of the curve as in FIG. 5. As such, if the angle of the horn 420 is smaller (in other words, the quad-ridge horn 420 has a smaller aperture) the length of the component polyrod 432, 434 should be larger. The starting width at the input end 436 (here 55.9 mm) is chosen so that a wave (especially for the mid to high frequencies) be captured by the cross-polyrod lens 430. In other words, the component polyrod 432, 434 extends outside of the ridges 422, 424, 426, 428. These mid to high frequency waves would be carried by this cross-polyrod lens 430 while the horn 420 and the outer lens (i.e., prolate spheroid lens described in the next section) are responsible for guidance of low frequency waves. In this manner, the foregoing dimensions are optimized for this specific horn 420. Depending on the kind of horn 420, the length of the component polyrod 432, 434 and the width of the bottom (start) 436 of the component polyrod 432, 434 can be modified to get the same smooth variation of the component polyrod (same curvature) 432, 434 as in FIG. 5. The length should be then extended so that the width of the tip 438 be smaller than a quarter of a wavelength at highest desired frequency to prevent back and forth reflections.

Implementation of Low-Frequency Lens—Prolate Spheroid Lens

The disclosed broadband antenna includes, in addition to the cross-polyrod lens described above in connection with FIGS. 4-5, a "low dielectric component". As explained in U.S. Pat. No. 7,889,148, such a low dielectric component will be the main contributor to the low frequency Gaussian beam formation. This makes the disclosed broadband antenna useful for material measurements in an admittance tunnel since the produced compact Gaussian beam will not hit the edges of the iris and cause unwanted diffractions.

Figure 6:
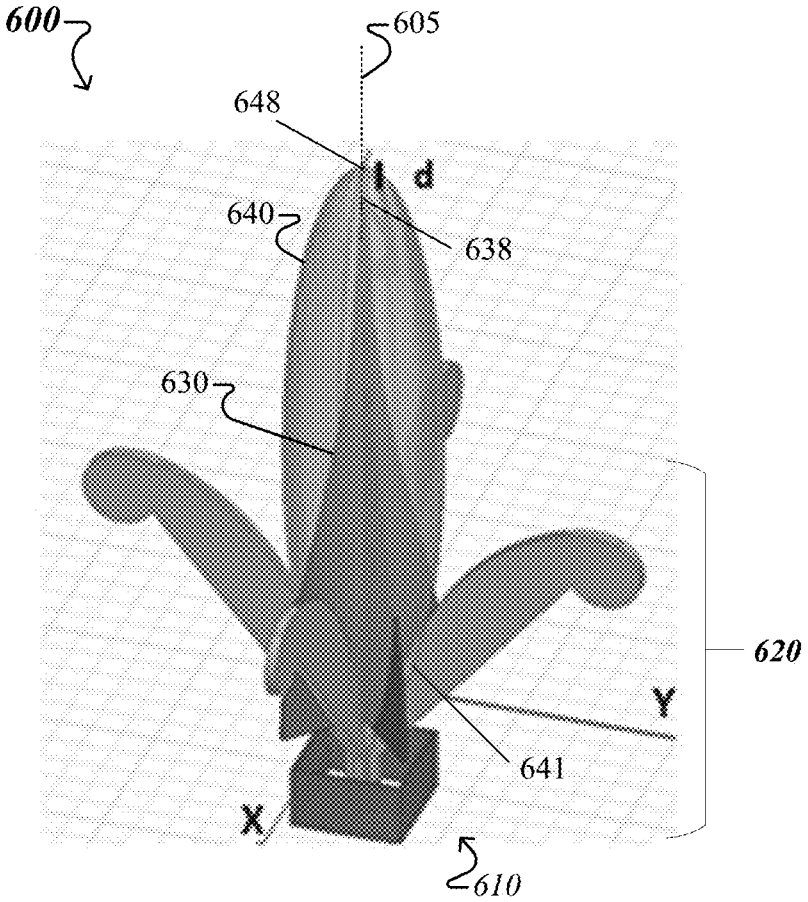
FIG. 6 shows an example of a broadband antenna with a cross-polyrod lens and prolate spheroid lens inserted inside a quad-ridge horn.

FIG. 6 shows a broadband antenna 600 that includes a quad-ridge horn 620 and its feed 610 (e.g., as described above in connection with FIGS. 3A, 4) and a combination of (i) a cross-polyrod lens 630 (e.g., like the one described above in connection with FIGS. 4-5) and (ii) a prolate spheroid lens 640. Note that both the cross-polyrod lens 630 and the prolate spheroid lens 640 are inserted inside a quad-ridge horn 620. Here the low dielectric component 640 is implemented as a lens that includes a dielectric material having a low permittivity. The shape of the low dielectric lens 640 is selected (i) to cause convergence of the low frequency waves and (i) to avoid interfering with the convergence of the high frequency waves caused by cross-polyrod lens 630. In some implementations, the shape of the low dielectric lens 640 can be a prolate spheroid that obeys parametric equations (4):

$$X=a_1 \sin \alpha \cos 13$$

$$Y=a_2 \sin \alpha \sin \beta$$

$$Z=a_3 \cos \alpha$$

$$a_1=a_2=50 \text{ mm}$$

$$a_3=200 \text{ mm}$$

$$0<\alpha<\pi$$

$$0<\beta<2\pi \quad (4).$$

Even though the prolate spheroid lens 640 is made of a low dielectric material such as foam with permittivity in a range of 1.2 to 1.6, e.g., 1.4, the wide tip 648 of this lens 640 could cause deviation of the rays guided by the cross-polyrod lens 630 from the center and cause a multi section hotspot. To prevent this problem, the parameters in the parametric equations (4) have been selected to form a relatively narrow prolate spheroidal shape. Here, the foregoing narrow shape of the outer lens (i.e., the prolate spheroid lens) 640 relates to the condition that a tip 638 of the inner lens (i.e., the cross-polyrod lens) 630 be at a distance d of less than a wavelength (at highest frequency) from the walls of the outer lens 640. A wide prolate spheroid (outer) lens 640 could degrade the performance of the cross-polyrod (inner) lens 630, since, in such case, the radiated waves would be guided by the outer lens 640 in directions other than the desired direction (along the z-axis).

Figure 7A:
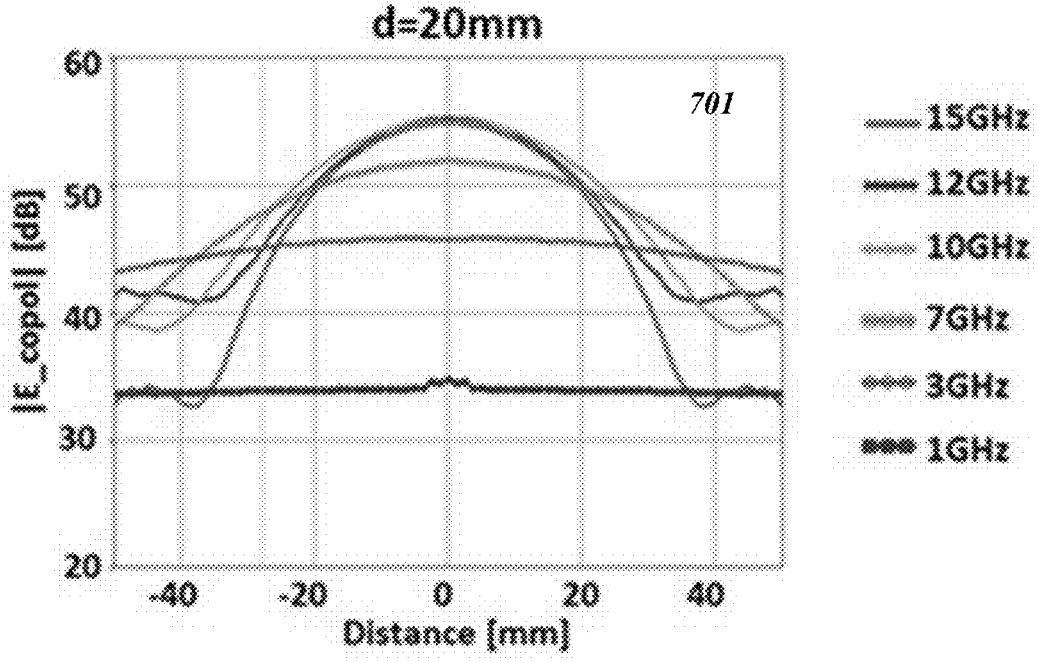
FIGS. 7A-7B show amplitude of a radiated near-field co-polarized component of an electric field along a line normal to the optical axis of a broadband antenna (e.g., from FIG. 6) and in front of the cross-polyrod lens tip for two marginal distances.
Figure 7B:
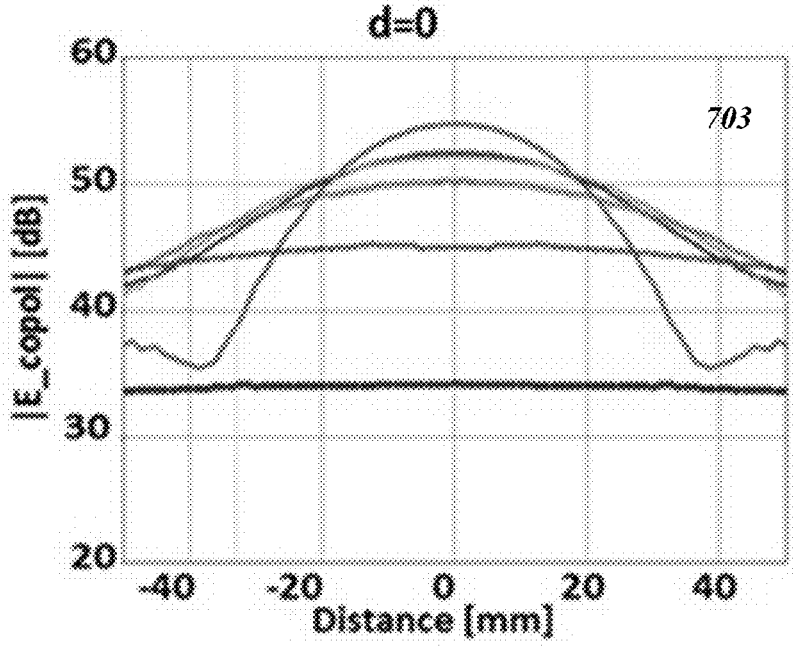

Relative positions of the cross-polyrod lens 630 and the prolate spheroid lens 640 with respect to each other and the quad-ridge horn 620 also are shown in FIG. 6. For instance, the distance d between the tips 638, 648 of the respective two lenses 630, 640 can be about 20 mm or less. This distance d can be decreased to zero (i.e., the tips 638, 648 of the respective two lenses 630, 640 meet each other) without affecting the overall performance of the broadband antenna 600, as shown in FIG. 7A. The performance of the broadband antenna 600 is expressed in FIG. 7A in terms of the amplitude of the radiated near-field co-polarized component of the electric field along a line normal to the optical axis 605 of the broadband antenna 600 and in front of the cross-polyrod lens tip 638. Here, the component of the radiating field which is along the incident field is referred to as the co-polarized component. FIGS. 7A-7B show amplitude of the radiated near-field co-polarized component of the electric field along a line normal to the optical axis 605 of the broadband antenna 600 and in front of the cross-polyrod lens tip 638 for two marginal distances of d=20 mm (in graph 701 of FIG. 7A) and d=0 (in graph 703 of FIG. 7B).

Additionally, the lengths (along the optical axis 605 of the broadband antenna 600) of the cross-polyrod lens 630 and the prolate spheroid lens 640 can vary as long as (i) the overall shape of the cross-polyrod lens 630 is reserved, e.g., based on equation (3), and (ii) a shape of the prolate spheroid lens 640 doesn't widen, especially close to the tip 648.

Moreover, a combination of (i) the cross-polyrod lens 630 and (ii) the prolate spheroid lens 640 can be manufactured by cutting a prolate spheroidal-shape foam symmetrically into four pieces, and inserting the cross-polyrod lens 630 inside these four pieces, then gluing all the pieces together. Any intrusion 641 into the foam of the prolate spheroid lens 640 by the metal ridges of the horn 620 can also be handled easily since the foam can be conveniently formed to an arbitrary shape, as described above.

Simulation Results (a) Near-Field Hot Spot and Cross-Polarization Level

Simulations have been conducted in which only one pair of the transmission line conductors (e.g., 202, 204 and 206, 208; or 302, 304 and 306, 308) is fed by an E field port. The fields are observed in the radiating near-field along a diagonal line near the tip 638, 648 of the combination of lenses 630, 640, e.g., at a location adjacent to an end of the combination of lenses that is distal to the quad-ridge horn 620. The component of the radiating field which is along the incident field is referred to as the co-polarized component and the one perpendicular to that is referred to as the cross-polarized component.

Figure 8:
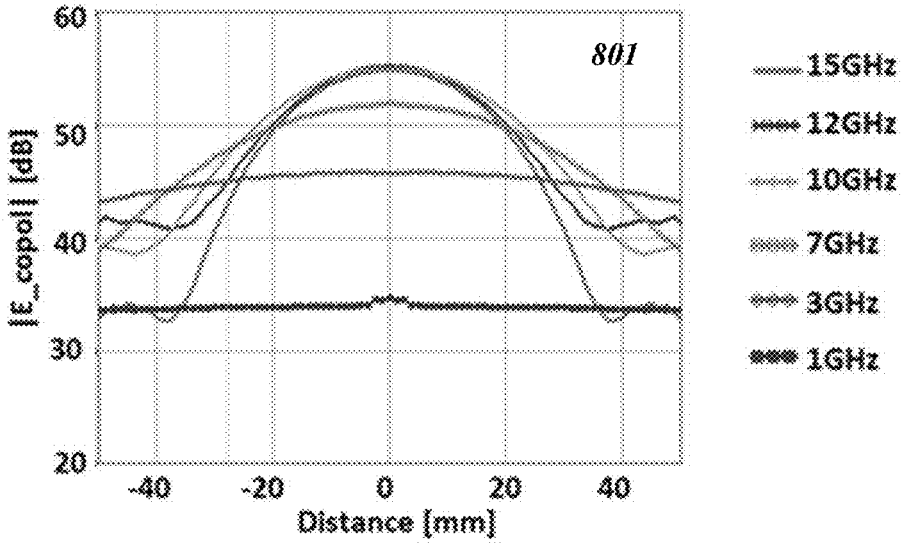
FIG. 8 shows amplitude of a radiated near-field co-polarized component of an electric field along a line normal to the optical axis of a broadband antenna (e.g., from FIG. 6) and in front of the cross-polyrod lens tip.

FIG. 8 is a graph 801 that shows an amplitude of the co-polarized E field along the diagonal line on an X-Y plane, i.e., at 45° with respect to X and Y axes and normal to the optical axis 605 of the broadband antenna 600, in front of the tip 638, 648 of the combination of lenses 630, 640. In this example, this line was located at a distance of 1 inch from the tip 648 of the prolate spheroid lens 640. This distance would be in the Fresnel zone for our range of simulation frequencies. Graph 801 of FIG. 8 indicates that the convergence of the fields can be observed more clearly with increasing the frequency.

Figure 9:
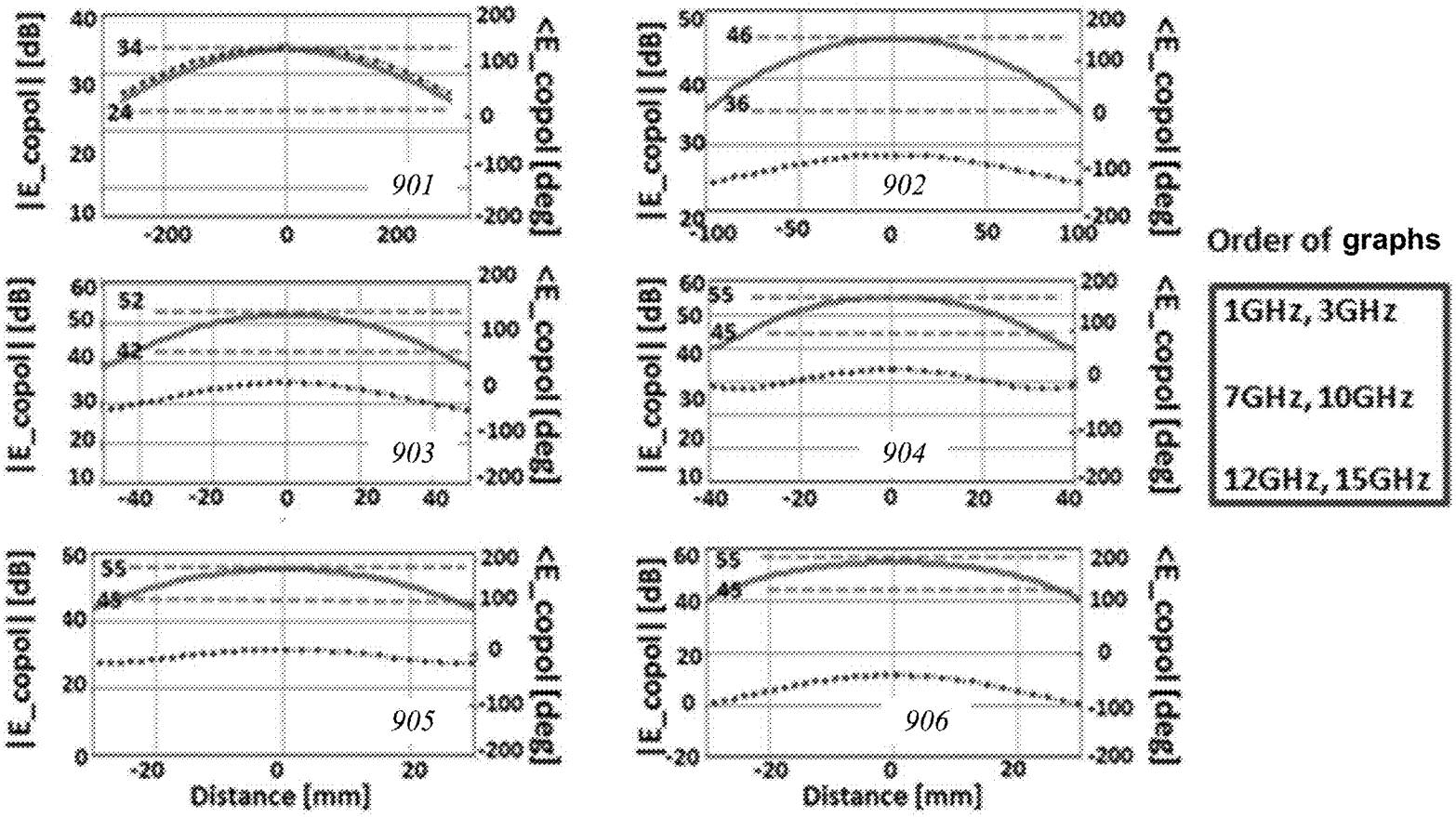
FIG. 9 shows amplitude and phase of a co-polarized component of an electric field along a line normal to the optical axis of a broadband antenna (e.g., from FIG. 6) and in front of the cross-polyrod lens tip.

FIG. 9 is a set of graphs 901-906 that show the amplitude (solid red line) and the phase (dotted blue line) of the co-polarized component of the electric field E along a line normal to the optical axis 605 of the broadband antenna 600. In this example, the borders of the 10 db near-field hot spots are designated in dashed green line. It can be seen in each of the graphs 901-906 that, even though the general trend is that the hotspot decreases as the frequency increases, the size of the hotspot for frequencies from 10-15 GHz does not change dramatically.

Figure 10:
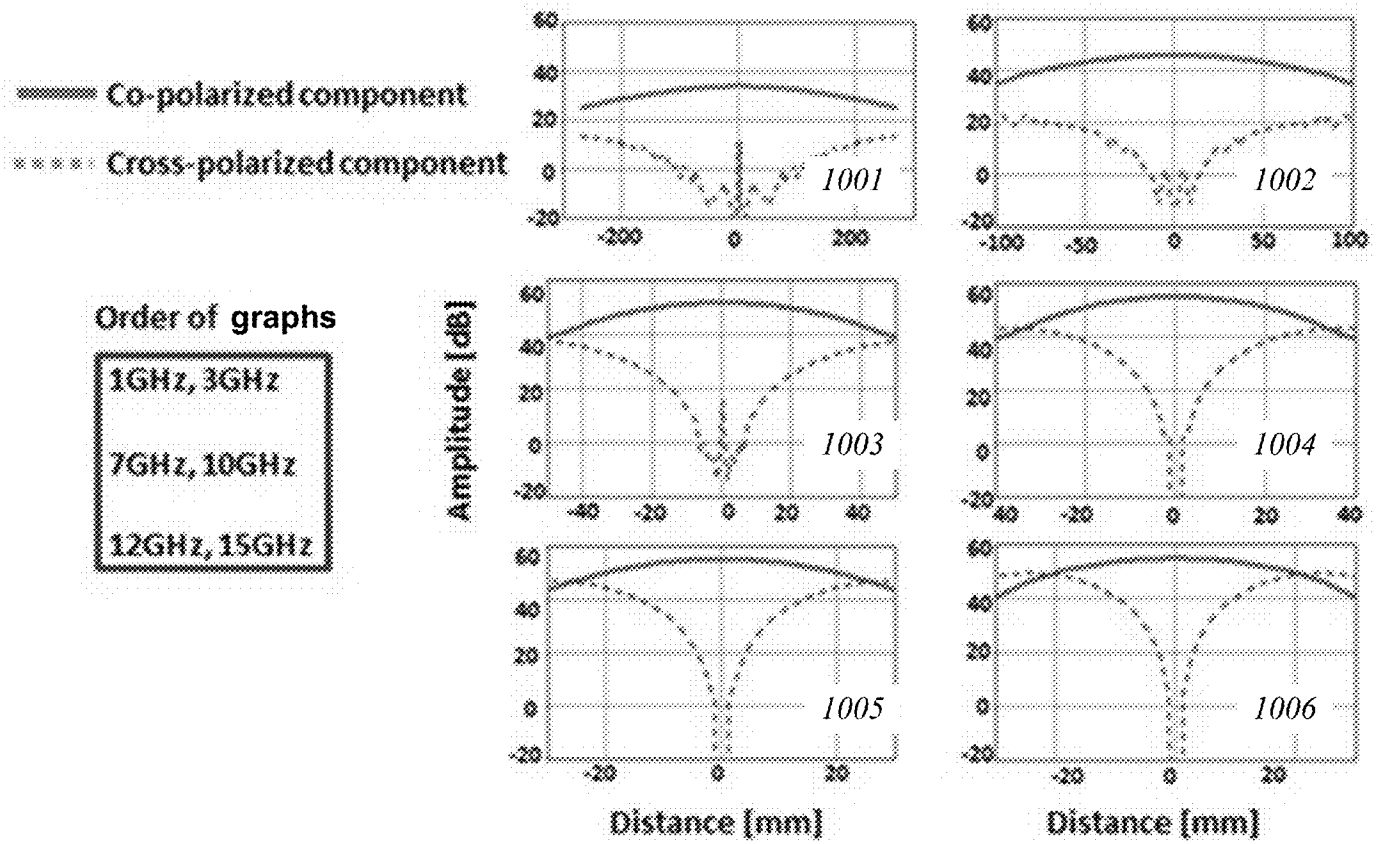
FIG. 10 shows levels of co-polarized and cross-polarized components of an electric field for different frequencies at a corresponding 10 dB-hotspot along a line normal to the optical axis of a broadband antenna (e.g., from FIG. 6) and in front of the cross-polyrod lens tip.

FIG. 10 is a set of graphs 1001-1006 that show co-polar and cross-polar components (with respect to the E field of the port) of the electric field for different frequencies, over the corresponding 10 dB-hotspot. In the examples illustrated in FIG. 10, the amplitude of the co-polarized E field and the amplitude of the cross-polarized E field are along the diagonal line on an X-Y plane normal to the optical axis 605 of the broadband antenna 600, at a distance of 1 inch in front of the tip 638, 648 of the combination of lenses 630, 640, and at 45 degrees with respect to X and Y axes. Graphs 1001-1006 indicate that the level of cross-polarized component is acceptably smaller than the co-polarized component for frequencies up to 12 GHz in the 10 dB hot spot. This makes the broadband antenna 600 a good candidate for the measurement of anisotropic materials in an admittance tunnel.

(b) Effect of Lenses

Figure 11:
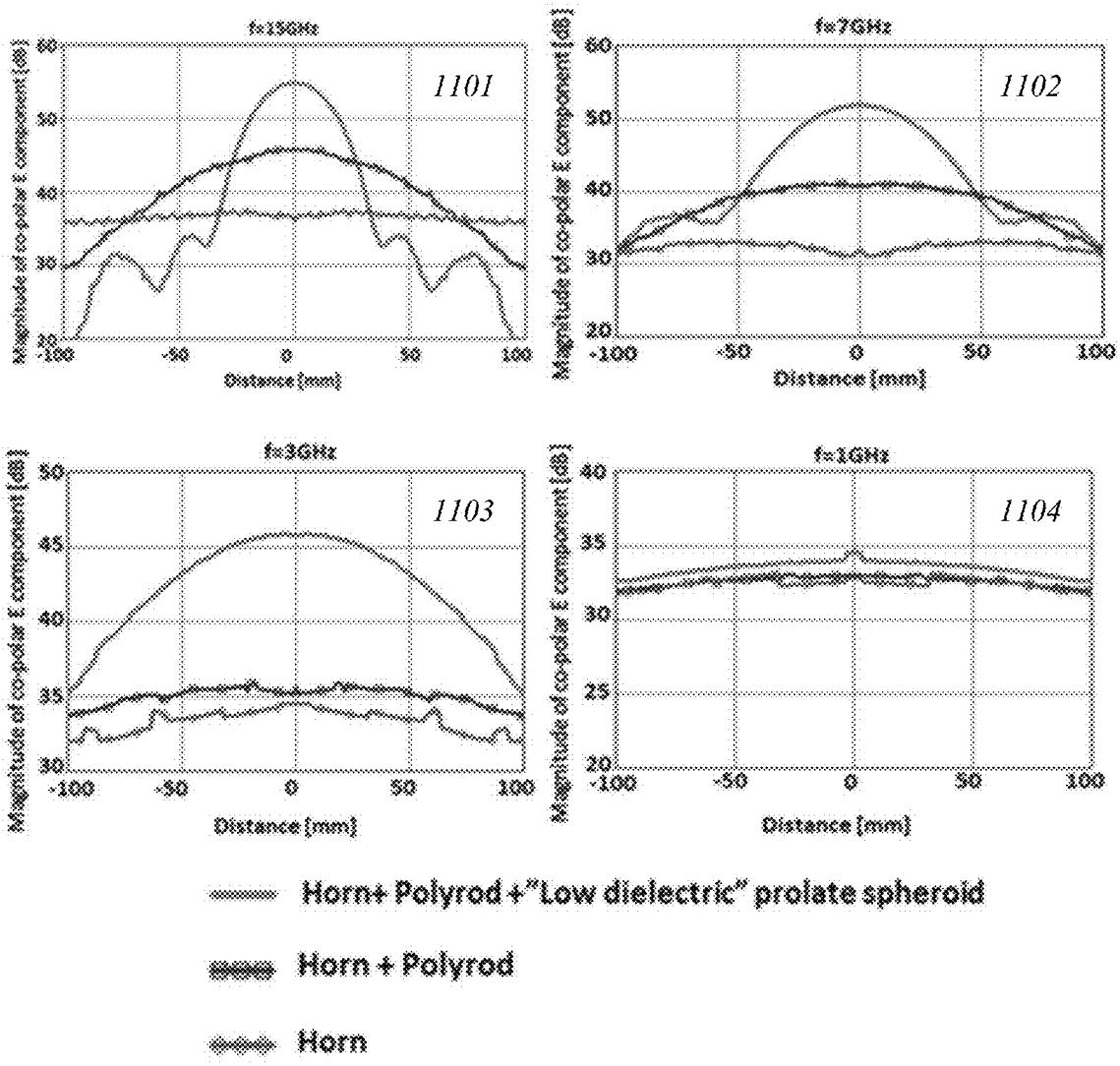
FIG. 11 shows an effect of each lens (cross-polyrod lens and prolate spheroid lens) in shaping a Gaussian beam produced at different frequencies for broadband antennas (e.g., from FIGS. 4 and 6).

FIG. 11 is a set of graphs 1101-1104 that show amplitude of the co-polarized component of the E field along a line normal to the optical axis 305, 405, or 605 of the broadband antenna 300, 400, or 600 when various components are combined with a simple quad-ridge horn. Baseline (green-diamond line) corresponds to broadband antenna 300 having the horn 320, when no lens was used, as shown in FIG. 3A. A first combination (blue-square line) corresponds to broadband antenna 400 having the horn 420 and cross-polyrod lens 430. A second combination (solid red line) corresponds to broadband antenna 600 having the horn 620, the cross-polyrod lens 630 and the prolate spheroidal lens 640. The graphs 1101-1104 indicate the effect of each lens (cross-polyrod lens 430, 630 and prolate spheroid lens 640) in shaping the Gaussian beam at different frequencies.

The improvement of the Gaussian formation of the waves at all frequencies as a result of adding the lenses 430, 630 and 640 to a horn 320, 420, 620 is clearly seen in graphs 1101-1104. It can also be observed in graphs 1101-1104 that the low dielectric prolate spheroid lens 640 has a remarkable improvement effect to the convergence of the waves using only the cross-polyrod lens 430, 630.

(c) Far-Field Radiation Patterns

Other than the near-field radiation patterns, the far-field radiation patterns are also of interest in case the disclosed broadband antennas will be used for far-field applications. Therefore, the far-field radiation patterns of antennas 300 and 600 obtained from simulations at some frequencies are discussed below. The interesting far-field radiation pattern for the broadband antenna 600 is the Theta-cut since the main beam is along the z-axis.

Figure 12:
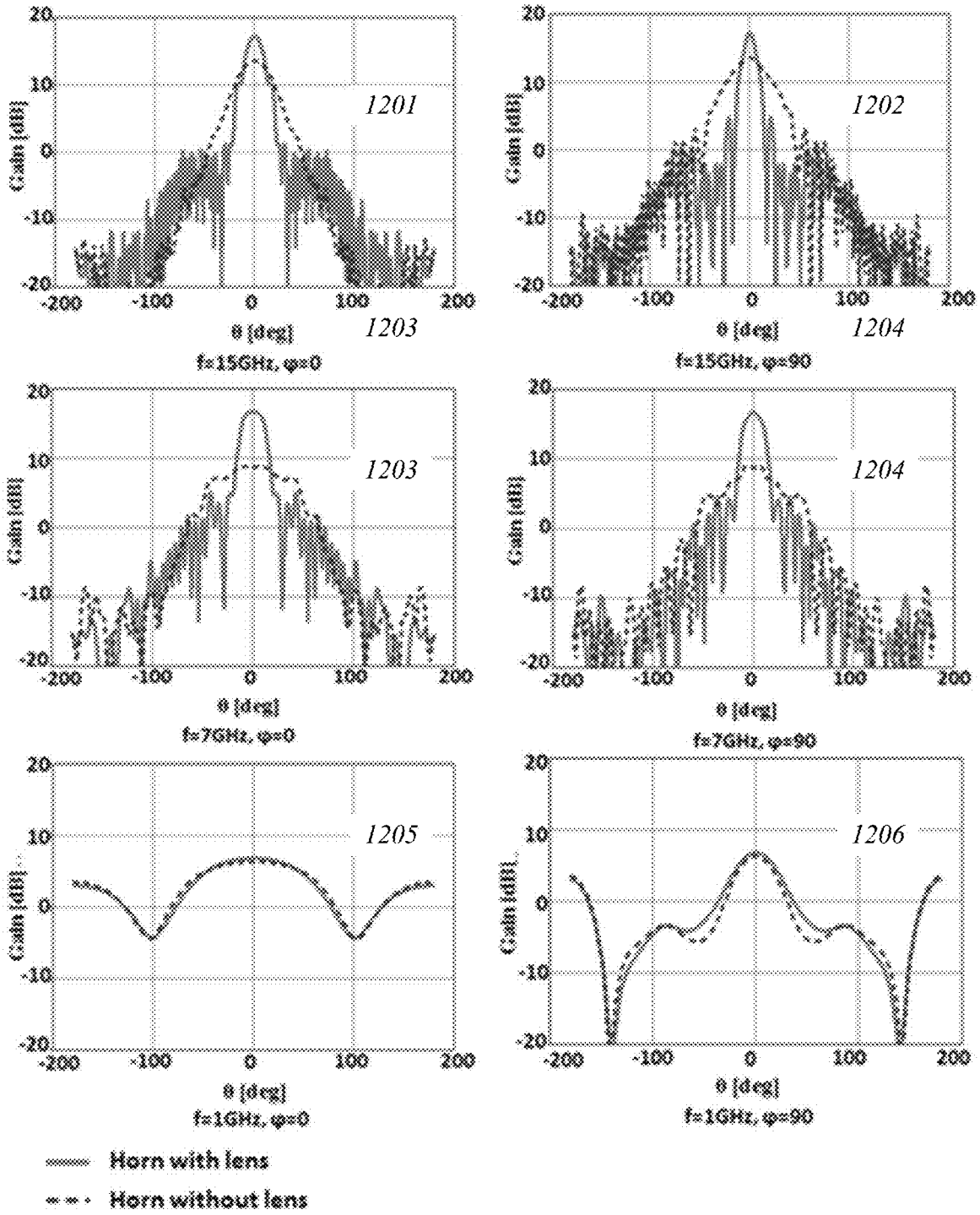
FIG. 12 shows far-field radiation pattern (gain) of broadband antennas (e.g., from FIGS. 3A and 6).

FIG. 12 is a set of graphs 1201-1206 that show the far-field radiation pattern that is the Theta-cut of the radiated E field at 15, 7, 1 GHz for 1=0, 90°. 1=90° is the plane of excited ridges in this simulation. Moreover, the graphs 1201-1206 show comparisons of corresponding gains for the broadband antenna 300 having the horn 320 without any lens (dotted blue curve) with those for the broadband antenna 600 having the horn 620, the cross-polyrod lens 630, and the prolate spheroid lens 640 (solid red curve). The far-field radiation pattern (gain) of the broadband antenna 600 illustrated in graphs 1201-1206 indicate that it is possible to use the broadband antenna 600 as a high directive antenna in the far-field. The improvement in gain (relative to the broadband antenna 300 having the horn 320 without any lens inserted inside it) is observed for the mid to high frequencies.

In this manner, for the mid to high frequencies, an average of 5-10 dB increase in gain is observed. As such, the broadband antenna 600 can potentially increase the directivity of a simple broadband antenna 300 at mid to high frequencies.

Potential Applications (i) Admittance Tunnel Measurements

There are several techniques to determine intrinsic properties of materials at microwave frequencies. Among them are transmission line measurement methods, resonance cavity measurement methods and free space measurement methods. The free space measurement methods are known to be more convenient than the other methods and they are relatively accurate. An admittance tunnel measurement method, which can be counted in the category of the free space methods, uses a compact region covered by absorbers all around. Two antennas are used as transmitter and receiver, and the sample under test is placed between these antennas on top a metal iris. This metal iris prevents any direct communications between the two antennas. This way, the antennas can "talk" to each other only through the material samples between them. For the admittance tunnel to be compact the transmitting and receiving antennas must be able to generate a plane wave at a relatively compact hot spot. This way, the unwanted diffractions are reduced from the edges of the iris or the edges of the material.

It has been shown that the conventional broadband antenna described in U.S. Pat. No. 7,889,148 is suitable for a compact admittance tunnel. The antenna disclosed herein, e.g., 600, is a dual-polarized version of a broadband antenna and, thus, an improvement over the noted conventional broadband antenna. As a result of having two feed ports, the disclosed broadband antenna can be used for measurements at different polarization by selecting an appropriate port without the requirement of rotating either the disclosed antenna or the sample. Therefore, such measurements and calibration processes would be sped up.

(ii) Measurements of Anisotropic Materials or Measurements at an Angle

The disclosed broadband antenna can be used for measurements of anisotropic materials. Similarly, the disclosed broadband antenna can be used for measurements at an angle. For instance, in some situations in which the direction of the incident field is of importance, a probe wave is directed to a sample surface at a non-zero angle of incidence with the normal to the sample surface.

Since the broadband antenna 600 provides two orthogonal orientation of the E field, there is no need to rotate it in order to examine the dependence of the electrical properties of a material-under-test on the direction of the incident field. This way the speed of measurement can be increased.

While this specification contains many specific implementation details, these should not be construed as limitations on the scope of any invention or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially be claimed as such, one or more features from a claimed combination can in some cases be excised from the combination, and the claimed combination may be directed to a subcombination or variation of a subcombination.

Similarly, while operations are depicted in the drawings and recited in the claims in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

What is claimed is:

1. A broadband antenna comprising:

a horn comprising a first feed arranged and configured such that the horn will provide, along an optical axis of the broadband antenna, a first input wave having a first polarization orthogonal to the optical axis, and a second feed arranged and configured such that the horn will provide along the optical axis a second input wave having a second polarization orthogonal to the optical axis and the first polarization;

a first lens arranged with a first end proximal to the horn and a second end distal to the horn, the first and second ends of the first lens being on the optical axis, the first lens comprising a first dielectric slab and a second dielectric slab that orthogonally intersect each other along the optical axis, and are rotated about the optical axis by 45° relative to the orthogonal first and second polarizations, such that the first dielectric slab and the second dielectric slab are EM coupled with either of the first feed and the second feed, wherein each of the first dielectric slab and the second dielectric slab comprises a first dielectric material having a first permittivity; and a second lens arranged with a first end proximal to the horn and second end distal to the horn, the first and second ends of the second lens being on the optical axis, such that the output end of the first lens is between the horn and the output end of the second lens, wherein the second lens is shaped to encapsulate at least portions of the first and second dielectric slabs that are adjacent to the optical axis, wherein the second lens comprises a second dielectric material having a second permittivity smaller than the first permittivity.

2. The broadband antenna of claim 1, wherein the horn further comprises a first pair of conductive ridges connected to the first feed and arranged parallel to the first polarization, and a second pair of conductive ridges connected to the second feed and arranged parallel to the second polarization.

3. The broadband antenna of claim 1, wherein each of the dielectric slabs is thinner than a quarter of a minimum wavelength of a beam produced by the broadband antenna, the minimum wavelength corresponding to a maximum frequency of an operating frequency range.

4. The broadband antenna of claim 1, wherein each of the dielectric slabs is wider adjacent to the first end of the first lens than adjacent to the second end of the first lens.

5. The broadband antenna of claim 4, wherein each of the dielectric slabs has a width that varies over at least a portion of its length based on a hyperbolic tangent function of a distance from the first end of the first lens.

6. The broadband antenna of claim 4, wherein each of the dielectric slabs has a width at the second end of the first lens that is smaller than a quarter of a minimum wavelength of a beam produced by the broadband antenna, the minimum wavelength corresponding to a maximum frequency of an operating frequency range.

7. The broadband antenna of claim 1, wherein the first material of each of the dielectric slabs has a permittivity in a range of 2-3.

8. The broadband antenna of claim 7, wherein the first material of each of the dielectric slabs is an acrylic.

9. The broadband antenna of claim 1, wherein the second lens is shaped as a prolate spheroid that is arranged with its long axis along the optical axis.

10. The broadband antenna of claim 9, wherein the second lens comprises four sectors of the prolate spheroid each of which is shaped as a quarter of prolate spheroid, the four sectors being arranged such that each pair of sectors is disposed adjacent to one side of one of the dielectric slabs and sandwiches half of the other one of the dielectric slabs.

11. The system of claim 1, wherein the second material of the second lens has a permittivity in a range of 1.2-1.6.

12. The broadband antenna of claim 11, wherein the second material of the second lens is a polymer foam.

13. The broadband antenna of claim 12, wherein the polymer foam is a polystyrene foam.

14. The broadband antenna of claim 1, wherein a combination of (i) respective dimensions of the horn, the first lens and the second lens and (ii) respective permittivities thereof is configured to cause the broadband antenna to produce Gaussian-like beams with waists located adjacent the second end of the second lens and amplitudes that vary less than 10 dB over frequencies in an operational frequency range of 0.7 GHz to 20 GHz.

15. A radiation source comprising:

the broadband antenna of claim 14; and a power source coupled to the broadband antenna, wherein the radiation source is configured to interchangeably power the first feed to cause the broadband antenna to produce a first Gaussian-like beam having the first polarization, or the second feed to cause the broadband antenna to produce a second Gaussian-like beam having the second polarization.

16. A measurement system for measuring material properties of a sample, the system comprising:

the radiation source of claim 15;

a sample holder having an aperture, the sample holder to support a sample disposed on a propagation path of Gaussian-like beams produced by the radiation source and directed through the sample and the aperture, wherein the sample holder is spaced apart from the radiation source such that the aperture is adjacent a location of waists of the Gaussian-like beams produced by the radiation source; and a receiver configured to receive the Gaussian-like beams transmitted through the sample and the aperture.

17. A method of fabricating a broadband antenna comprising a horn configured to provide, along an optical axis of the broadband antenna, (i) a first input wave having a first polarization orthogonal to the optical axis, and (ii) a second input wave having a second polarization orthogonal to the optical axis and the first polarization, the method comprising:

forming a first lens from a first dielectric slab and a second dielectric slab by arranging the second dielectric slab to intersect orthogonally the first dielectric slab, wherein each of the first dielectric slab and the second dielectric slab comprises a first dielectric material having a first permittivity;

inserting at least a portion of the first lens into the horn, such that the intersected first and second dielectric slabs are rotated about the optical axis by 45° relative to the orthogonal first and second polarizations; and forming a second lens by (i) cutting a prolate spheroid symmetrically into four pieces along its long axis, and (ii) inserting the first lens inside the four pieces so they, at least partially, encapsulate the first lens, wherein the prolate spheroid comprises a second dielectric material having a second permittivity smaller than the first permittivity.

18. The method of claim 17, further comprising shaping each of the first and second dielectric slabs to have a width that varies over at least a portion of its length based on a hyperbolic tangent function, wherein the inserting of the at least a portion of the first lens into the horn comprises inserting a wider end of each of the first and second dielectric slabs into the horn, such that a narrower end of each of the first and second dielectric slabs protrudes outside of the horn.

19. The method of claim 17, further comprising forming each of the first and second dielectric slabs to have both a thickness and a distal-end width that are smaller than a quarter of a minimum wavelength of a beam produced by the broadband antenna, the first lens being inserted into the horn such that the distal end of the first and second dielectric slabs protrudes outside of the horn, wherein the minimum wavelength corresponding to a maximum frequency of an operating frequency range.

20. The method of claim 17, wherein the cutting of the prolate spheroidal shape symmetrically into four pieces along its long axis comprises obtaining four sectors of the prolate spheroid each of which being shaped as a quarter of prolate spheroid, and the inserting of the first lens inside the four pieces comprises arranging the four sectors such that each pair of sectors is disposed adjacent to one side of one of the dielectric slabs and sandwiches half of the other one of the dielectric slabs.

* * * * *